US010657791B2

(12) United States Patent
Gerken et al.

(10) Patent No.: US 10,657,791 B2
(45) Date of Patent: May 19, 2020

(54) INTERACTIVE SECURITY ALERT AND CONTROL

(71) Applicant: INTERNATIONAL BUSINESS MACHINES CORPORATION, Armonk, NY (US)

(72) Inventors: John Gerken, Apex, NC (US); Michele C. Stewart-Smith, Round Rock, TX (US); Fernando Ewald, Austin, TX (US); Diogo S. Araujo, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/574,485

(22) Filed: Sep. 18, 2019

(65) Prior Publication Data

US 2020/0126393 A1 Apr. 23, 2020

Related U.S. Application Data

(63) Continuation of application No. 16/168,142, filed on Oct. 23, 2018, now abandoned.

(51) Int. Cl.

| | |
|---|---|
| ***G08B 21/22*** | (2006.01) |
| ***G08B 7/06*** | (2006.01) |
| ***G08B 6/00*** | (2006.01) |

(52) U.S. Cl.
CPC ..... *G08B 21/22* (2013.01); *G08B 6/00* (2013.01); *G08B 7/06* (2013.01)

(58) Field of Classification Search
CPC ..... G08B 21/22; G08B 6/00; G08B 7/06
USPC ..... 340/690, 506, 539.1, 539.11, 573.1
See application file for complete search history.

(56) References Cited

U.S. PATENT DOCUMENTS

| | | | |
|---|---|---|---|
| 4,507,716 | A | 3/1985 | Benedict, Jr. |
| 5,400,246 | A | 3/1995 | Wilson |
| 5,959,529 | A | 9/1999 | Kail, IV |
| 9,245,439 | B2 | 1/2016 | Lamb |
| 9,704,376 | B2 | 7/2017 | Eyring |
| 2015/0308178 | A1 | 10/2015 | Warren |
| 2016/0189528 | A1 | 6/2016 | Lee |
| 2016/0247370 | A1 | 8/2016 | Lamb |

(Continued)

FOREIGN PATENT DOCUMENTS

DE 1020160026061 A1 9/2016

OTHER PUBLICATIONS

Anonymous; Reducing Security System False Alarms via Mobile Device Interaction; IP.com; Technical Disclosure, Sep. 10, 2015; 3 pages.

(Continued)

*Primary Examiner* — Daryl C Pope
(74) *Attorney, Agent, or Firm* — Schmeiser, Olsen & Watts; Mark C. Vallone

(57) ABSTRACT

A method and system for improving an interactive security alert process is provided. The method includes querying a status associated with an alarm system resulting in detection of an alarm system active state and detecting a user located within a specified proximity of an exit point location of a structure. An alert indicating that the user is located within the specified proximity of the exit point location of the structure is generated. The alert is presented to the user and feedback associated with the alert is received from the user.

20 Claims, 7 Drawing Sheets

(56) References Cited

U.S. PATENT DOCUMENTS

| | | | | |
|---|---|---|---|---|
| 2016/0306062 | A1* | 10/2016 | Keene | G01R 33/288 |
| 2019/0043294 | A1* | 2/2019 | Runyon | G06F 21/32 |

OTHER PUBLICATIONS

Chang, Alexandra; Your Door is About to Get Clever: 5 Smart Locks Compared; Jun. 19, 2013; retrieved from the Internet; https://www.wired.com/2013/06/smart-locks/; 8 pages.
Contributor; How to Install a Radar Proximity Motion Sensor for Car Alarms; retrieved from the Internet; https://itstillruns.com/proximity-motion-sensor-car-alarms-2192517.html; 6 pages.
Friedman, Mark J.; List of IBM Patents or Patent Applications Treated as Related; Sep. 18, 2019; 1 page.
Smart Home Door Lock Security—Home Connect Technology, Remote Door Locks; https://www.kwikset.com/wireless-technology/homeowners/index.aspx; retrieved from the Internet; 3 pages.
Smart Home Protocols Explained: Thread, Zigbee, Z-Wave, KNX and More; retrieved from the Internet; https://medium.com/iotforall/smart-home-protocols-thread-zigbee-z-wave-knx-and-more-71efa4b410e1; 8 pages.

* cited by examiner

INTERACTIVE SECURITY ALERT AND CONTROL

CROSS REFERENCE TO RELATED APPLICATIONS

This application is a continuation application claiming priority to Ser. No. 16/168,142 filed Oct. 23, 2018, the contents of which are hereby incorporated by reference.

FIELD

The present invention relates generally to a method for generating a security alert with respect to a user and in particular to a method and associated system for improving interactive security system technology associated with enabling sensors for detecting a user located within an exit point location of a structure and executing associated actions for automatically generating an associated alert and controlling a functionality of an alarm system.

BACKGROUND

Security systems are typically used to detect and warn individuals of unauthorized activity. For example, an individual may install a security system in a home or automobile to warn of intruders attempting to gain access to the home or automobile.

SUMMARY

A first aspect of the invention provides an interactive security alert improvement method comprising: querying, by the processor, a status associated with an alarm system resulting in detection of an active state associated with the alarm system; detecting in real time, by the processor via a sensor communicatively connected to the alarm system, a user located within a specified proximity of an exit point location of a structure, wherein the user is currently located within the structure such that the exit point location prevents the user from exiting the structure; generating, by the processor, an alert indicating that the user is located within the specified proximity of the exit point location of the structure; presenting, by the processor, the alert to the user; and receiving, by the processor from the user via a user interface, feedback associated with the alert.

A second aspect of the invention provides a computer program product, comprising a computer readable hardware storage device storing a computer readable program code, the computer readable program code comprising an algorithm that when executed by a processor of a connected device implements an interactive security alert improvement method, the method comprising: querying, by the processor, a status associated with an alarm system resulting in detection of an active state associated with the alarm system; detecting in real time, by the processor via a sensor communicatively connected to the alarm system, a user located within a specified proximity of an exit point location of a structure, wherein the user is currently located within the structure such that the exit point location prevents the user from exiting the structure; generating, by the processor, an alert indicating that the user is located within the specified proximity of the exit point location of the structure; presenting, by the processor, the alert to the user; and receiving, by the processor from the user via a user interface, feedback associated with the alert.

A third aspect of the invention provides a hardware device comprising a processor coupled to a computer-readable memory unit, the memory unit comprising instructions that when executed by the computer processor implements an interactive security alert method comprising: querying, by the processor, a status associated with an alarm system resulting in detection of an active state associated with the alarm system; detecting in real time, by the processor via a sensor communicatively connected to the alarm system, a user located within a specified proximity of an exit point location of a structure, wherein the user is currently located within the structure such that the exit point location prevents the user from exiting the structure; generating, by the processor, an alert indicating that the user is located within the specified proximity of the exit point location of the structure; presenting, by the processor, the alert to the user; and receiving, by the processor from the user via a user interface, feedback associated with the alert.

Embodiments of the present invention advantageously provides a simple method and associated system capable of accurately detecting user activities.

DETAILED DESCRIPTION

Figure 1:
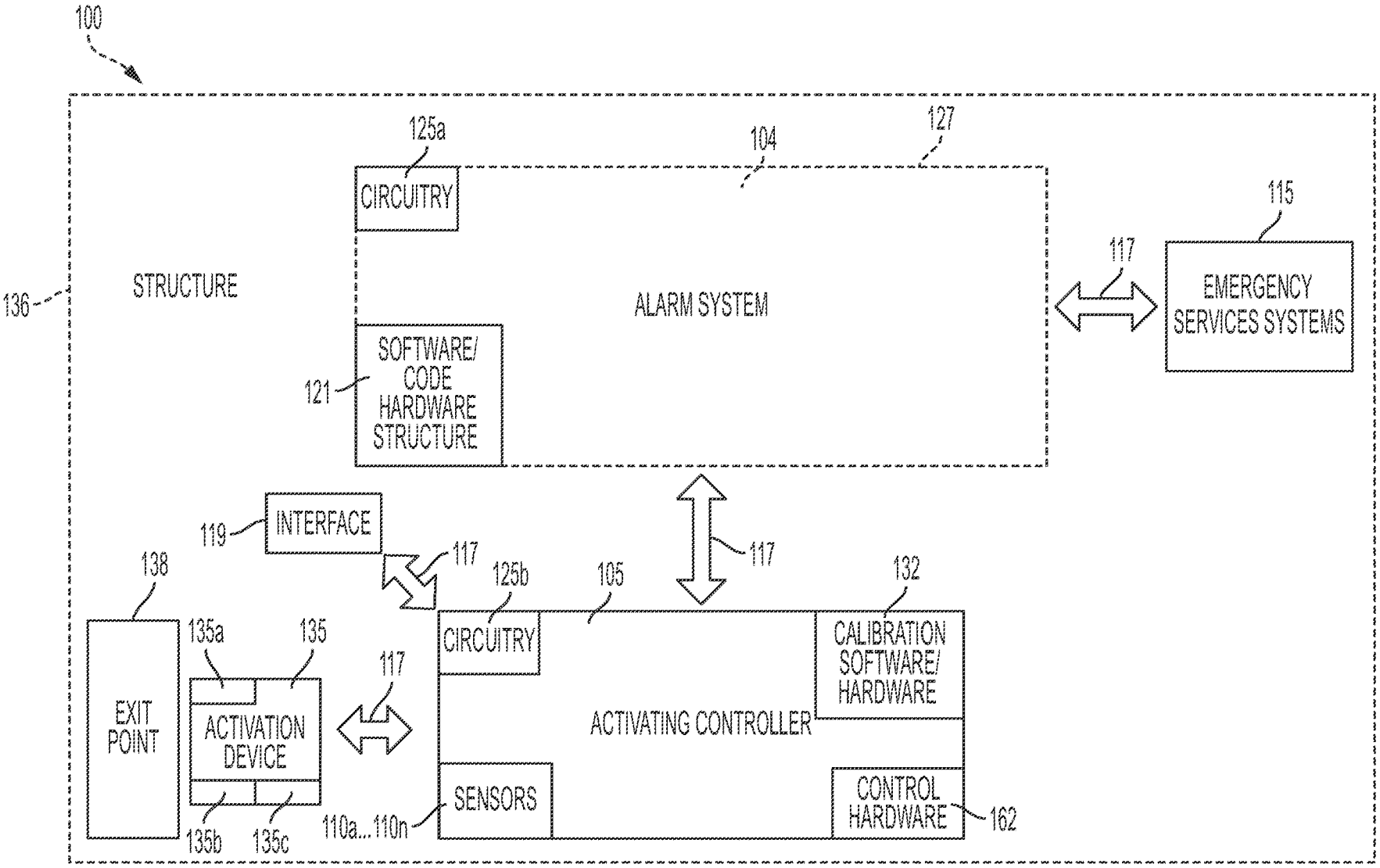
FIG. 1 illustrates a system for improving interactive security system technology associated with enabling sensors for detecting a user located within an exit point location of a structure and executing associated actions for automatically generating an associated alert and controlling a functionality of an alarm system, in accordance with embodiments of the present invention.

FIG. 1 illustrates a system 100 for improving interactive security system technology associated with enabling sensors

110*a* . . . 110*n* for detecting a user located within an exit point location 138 of a structure 136 and executing associated actions for automatically generating an associated alert and controlling a functionality of an alarm (security) system 104, in accordance with embodiments of the present invention. System 100 enables a process for enabling a connected device (e.g., a door knob/latch of activation device 135) for warning a user (that is about to activate the connected device for exiting a structure) that an active alarm system may be triggered in response to the activation. The warning is enabled to prevent false alarms that may result in unnecessary calls to monitoring centers, fees incurred for government responders (e.g., police, fire department, ambulance, etc.), waking up sleeping individuals, etc. The connected device is communicatively connected to alarm system 104 and is enabled to determine if alarm system 104 is armed. The connected device includes an internal or external warning mechanism that may be triggered when a user interacts with or is about to interact with the connected device while alarm system is armed. Therefore, system 100 is configured to enable an alarm system that includes:

1. A proximity or touch sensor that may be enabled or disabled for sensing potential interaction.
2. A security system hardware-based hub for determining a state of the alarm system.
3. An individual that is about to interact with the sensor.
4. A warning mechanism controlled by the hardware-based hub for alerting the individual prior to activating a primary alarm while the sensor is enabled.

System 100 of FIG. 1 includes an alarm system 104, an activating controller 105 (i.e., specialized hardware device), an activation device 135, an interface 119, and emergency services systems 115 interconnected through a network 117. Alarm system 104, activating controller 105, interface 119, and activation device 135 are located within a structure (e.g., a building, a fenced in area, etc.). Additionally, system 100 includes an exit point apparatus 138 within structure 136. The exit point apparatus 138 may comprise a door, a window, a fence gate, etc. Activation device 135 includes a connected device 135*a* (e.g., a door knob and latch), sensors 135*b*, and control circuitry 135*c*. Alarm system 104 includes specialized circuitry 125*a* (that may include specialized software) and software code/hardware structure 121. Activating controller 105 may include any type of hardware controller device. Activating controller 105 may be Bluetooth enabled to provide connectivity to any type of alarm system. Activating controller 105 includes specialized circuitry 125*b* (that may include specialized software), calibration software/hardware 132, control hardware 162, and sensors 110*a* . . . 110*n*. Sensors 110*a* . . . 110*n* and sensors 135*a* may include any type of internal or external sensors including, inter alia, a touch sensor, a motion detector, an audio sensor, a temperature sensor, a voltage sensor, a heart rate monitor, a blood pressure monitor, a pulse rate monitor, an ultrasonic sensor, an optical sensor, a video retrieval device, humidity sensors, facial recognition sensor, fingerprint sensor, etc. Control hardware 162 may comprise devices for automatically controlling alarm system 104 and/or activation device 135 with respect to a detected user proximity. For example, control hardware 162 may include a controller for activating a solenoid for enabling or disabling alarm system 104 and/or automatically opening, closing, or locking a door knob in response to detecting a user located proximate to an exit point location 138 of structure 136. Calibration software/hardware 132 may include specialized testing circuitry/logic for calibrating activating controller 105 and activation device 135. Activating controller 105 and activation device 135 may each may comprise an embedded device. An embedded device is defined herein as a dedicated device or computer comprising a combination of computer hardware and software (fixed in capability or programmable) specifically designed for executing a specialized function. Programmable embedded computers or devices may comprise specialized programming interfaces. In one embodiment, activating controller 105 and activation device 135 may each comprise a specialized hardware device comprising specialized (non-generic) hardware and circuitry (i.e., specialized discrete non-generic analog, digital, and logic-based circuitry) for (independently or in combination) executing a process described with respect to FIGS. 1-7. The specialized discrete non-generic analog, digital, and logic based circuitry may include proprietary specially designed components (e.g., a specialized integrated circuit, such as for example an Application Specific Integrated Circuit (ASIC) designed for only implementing an automated process for improving interactive security system technology associated with enabling sensors 110*a* . . . 110*n* for detecting a user located within an exit point location 138 of a structure 136 and executing associated actions for automatically generating an associated alert and controlling a functionality of an alarm (security) system 104. Interface 119 may comprise a mobile device, a panel interface, a touchscreen interface, an audio/video receiver, a virtual/holographic interface, etc. for receiving audible, visual, or touch based commands form a user for controlling a functionality of alarm system 104 and/or activating controller 105. Network 117 may include any type of network including, inter alia, a local area network, (LAN), a wide area network (WAN), the Internet, a wireless network, etc. Alternatively, network 117 may include application programming interfaces (API). Emergency services systems comprises a system for notifying an emergency services provider (e.g., a paramedic or hospital, a police station, a fire station, etc.).

In one embodiment, system 100 enables a door knob (i.e., at an inward facing exit point location) comprising connectivity with a security system hub such that a controller detects when the security system hub is enabled (e.g., armed). Therefore, a user touching or coming within a proximity of the door knob causes a warning mechanism to activate (i.e., via sound, light, vibration, etc.) thereby notifying the user that the security system hub is armed. Additionally, alternative forms of interaction sensors may be enabled. For example, biometric sensors may be enabled to identify a user via facial recognition, fingerprint, etc. to further delineate actions that the door knob may take. Identifying the user may cause additional actions to be executed. For example, user identification may trigger alarm system 104 to temporarily (for a specified time period) deactivate so that a false alarm is not triggered. As an additional example, user identification may trigger alarm system 104 to notify external authorities that a false alarm has been triggered. Additionally, a specialized alert may be generated based on each user's identity. For example, a first user may trigger a visual alert based on an associated identity and a second user may trigger an audible alert based on an associated identity.

Figure 2:
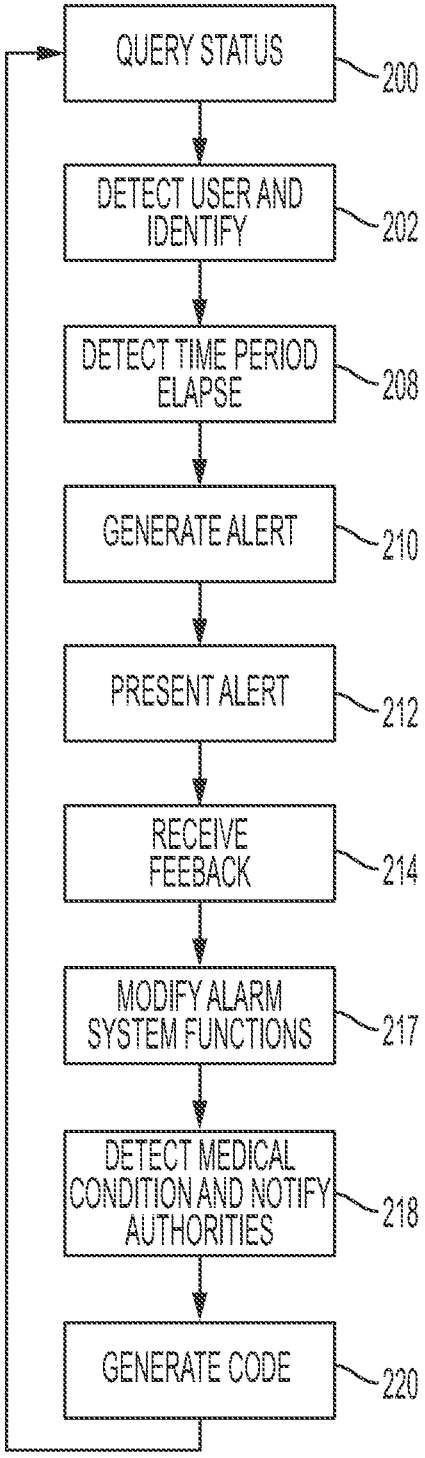
FIG. 2 illustrates an algorithm detailing a process flow enabled by the system of FIG. 1 for improving interactive security system technology associated with enabling sensors for detecting a user located within an exit point location of a structure and executing associated actions for automatically generating an associated alert and controlling a functionality of an alarm system, in accordance with embodiments of the present invention.

FIG. 2 illustrates an algorithm detailing a process flow enabled by system 100 of FIG. 1 for improving interactive security system technology associated with enabling sensors for detecting a user located within an exit point location of a structure and executing associated actions for automatically generating an associated alert and controlling a functionality of an alarm system, in accordance with embodiments of the present invention. Each of the steps in the algorithm of FIG. 2 may be enabled and executed in any order by a computer processor(s) executing computer code. Additionally, each of the steps in the algorithm of FIG. 2 may be enabled and executed in combination by one or more components of system 100 such as alarm system 104, activating controller 105, activation device 135, etc. In step 200, a status associated with an alarm system is queried resulting in detection of an active state status associated with the alarm system. Alternatively or additionally, a status of the alarm system may include, inter alia, self-diagnosis status, a malfunctioning status, a calibration status etc. In step 202, a user located within a specified proximity of an exit point location of a structure is detected and identified (via a sensor such as a touch activated sensor, a proximity sensor, a biometric sensor, etc.) in real time. The user is currently located within the structure such that the exit point location prevents the user from exiting the structure. In step 208, it is detected that a specified time period has elapsed since the user has been located within the specified proximity of the exit point location of the structure. Alternatively, the specified time period may include an amount of time elapsed since the user has been located within a specified proximity an exit point activation device (e.g., a door knob) for allowing the user to access the exit point location of the structure. In step 210, an alert indicating that the user is located within the specified proximity of the exit point location of the structure (e.g., for the elapsed specified time period detected in step 208) is generated. In step 212, the alert (e.g., audible, visual, vibrational, etc.) is presented to the user. In step 214, feedback associated with the alert is received from the user via an interface (e.g., interface 119 of FIG. 1). The feedback may include user control commands provided to the system. For example, the feedback may indicate a modification to the specified time period for allowing the user more or less time to be elapsed before generating the alert generated in step 210. As an additional example, the feedback may indicate a modification to the specified proximity distance so that the user must be closer to the exit point location before the alert is generated. Additionally, the feedback may be used to generate or modify software code for executing future processes. In step 217, functions of the alarm system are modified in response to the feedback received in step 214. For example, the alarm system may be, inter alia, enabled, disabled, etc. Alternatively, the alarm system may be temporarily disabled for a specified time period for allowing the user to exit the exit point location of the structure without fully disabling the alarm system. Additionally, the feedback may be used for generating or modifying software code for executing future proximity alerts with respect to the exit point location as described, infra, with respect to step 220. In step 218, a medical condition associated with the identified user may be detected via a sensor. For example, an injured user (e.g., having a leg injury) may be unable to enter or exit a zone associated with the specified proximity of the exit point location within the specified time period thereby causing a false alarm. Therefore, a biometric or speed sensor may be enabled for detecting an identity and a current movement speed with respect to a baseline speed of the user resulting in detection of a slower than normal speed for the user thereby indicating a possible leg injury for the user. Additionally, an emergency services system may receive a notification indicating the medical condition. In step 220, software code (for executing future security alert processes) is generated based on the feedback of step 214. The software code may be executed by system 100 of FIG. 1 for enabling sensors for detecting a user located within an exit point location of a structure and executing modified actions for automatically generating a modified associated alert and controlling a modified functionality of the alarm system. Therefore, the software code is generated and executed and the algorithm is repeated in a modified manner.

Figure 3:
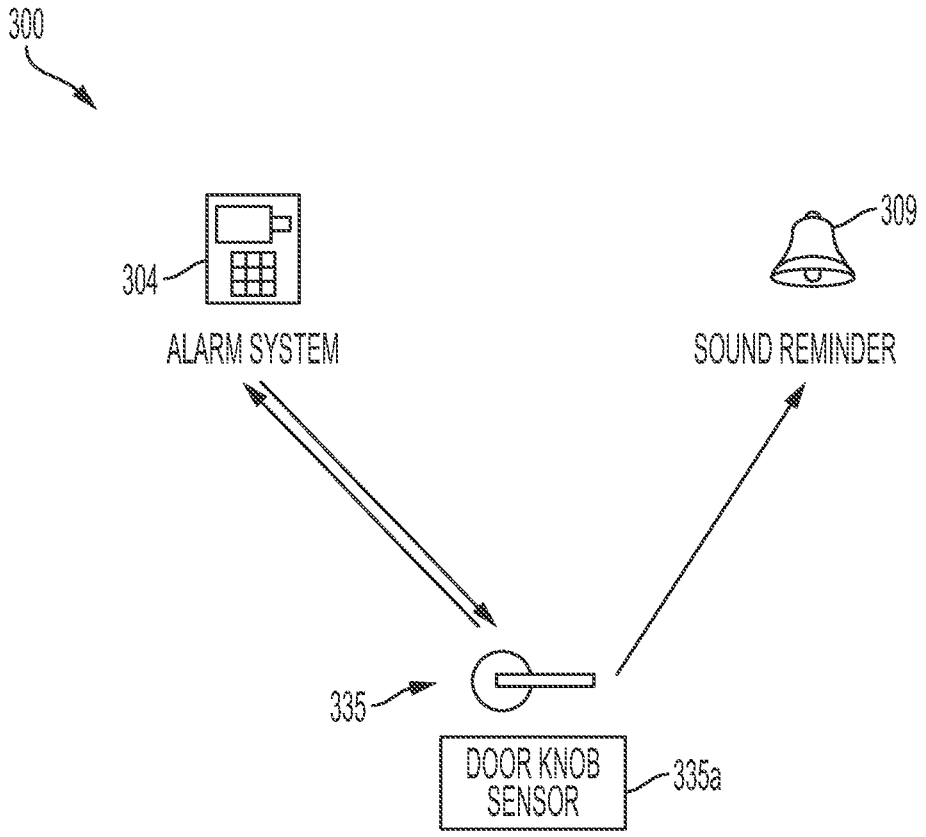
FIG. 3 illustrates a first implementation example for improving interactive security system technology associated with enabling sensors for detecting a user located within an exit point location of a structure, in accordance with embodiments of the present invention.

FIG. 3 illustrates an implementation example comprising a system 300 for generating a security alert, in accordance with embodiments of the present invention. The following implementation example (executed by system 300) describes a process for preventing a false alarm with respect to an alarm system 304. For example, system 300 may track a state of alarm system 304. Likewise, a doorknob sensor **335*a* integrated with a door knob 335 detects a user via a touch or proximity attributes. If the alarm state comprises an enabled state and the doorknob sensor 335*a* is tripped, an alert is transmitted to an alarm device 309 activated to generate and present an audible reminder indicating that the user has activated door knob sensor 335*a* thereby preventing a false alarm. Alarm device 309 comprises an additional alarm device with respect to the alarm/security system used for detecting intruders. For example, alarm device 309 is enabled for detecting a user within a proximity of actually triggering an alarm/security system used for detecting intruders. Alarm device 309** warns a user (via audible, visual, or vibrational means) that they are in danger of triggering the alarm system for warning against possible intruders and transmitting an alert to a security company or the police.

Figure 4:
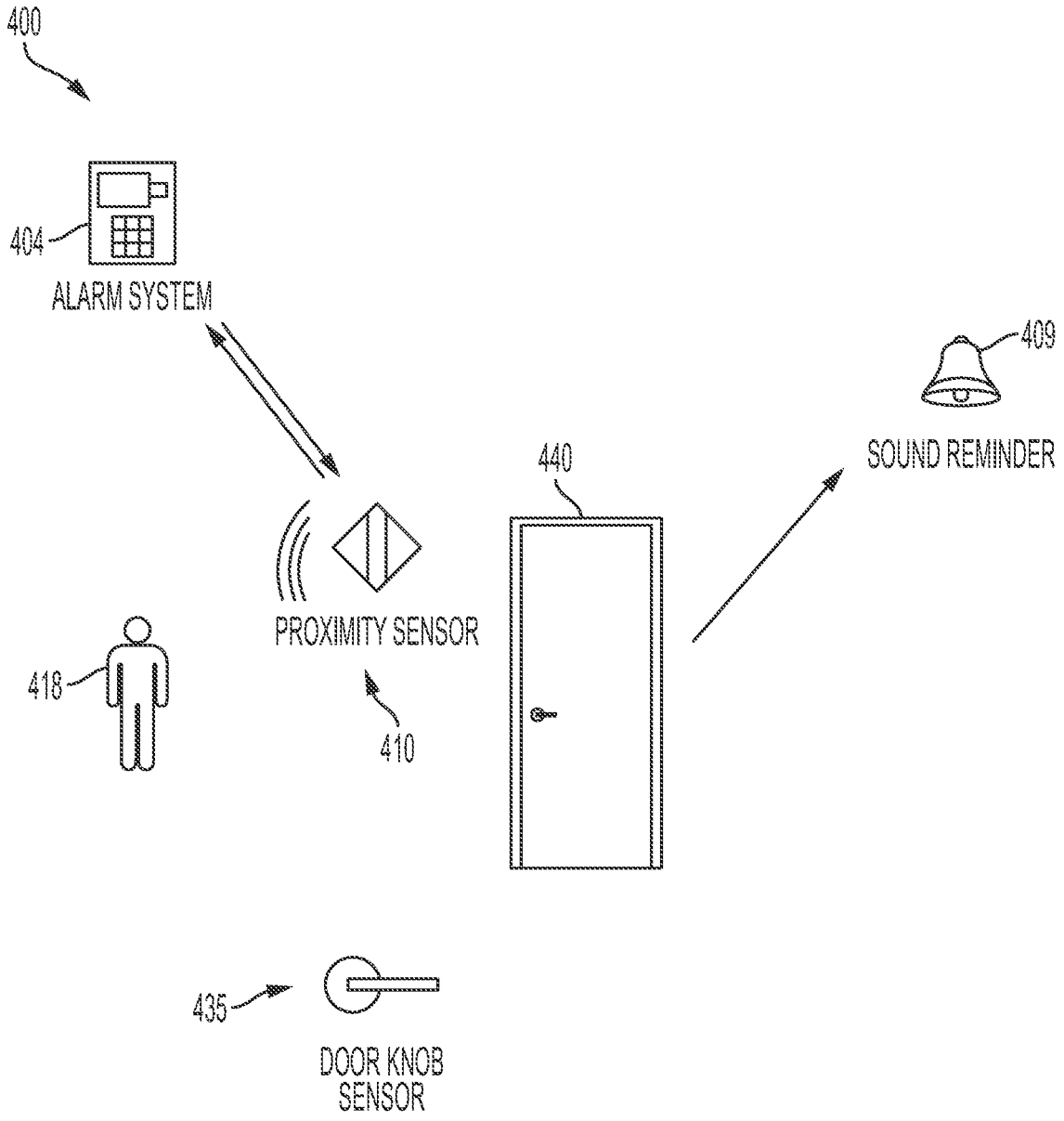
FIG. 4 illustrates a second implementation example for improving interactive security system technology associated with enabling sensors for detecting a user located within an exit point location of a structure, in accordance with embodiments of the present invention.

FIG. 4 illustrates an implementation example comprising a system 400 for generating a proximity enabled alert, in accordance with embodiments of the present invention. The following implementation example (executed by system 400) describes an alternative process (to the process of FIG. 3) for preventing a false alarm with respect to an alarm system 409. For example, system 400 may enable a proximity sensor 410 for detecting a user 418 within a specified proximity of an exit door 440. Additionally, a sensor within a door knob 435 may be enabled to further detect user 418 touching doorknob 435. In response to detecting the user proximity and the user touch, an alert is transmitted to an alarm device 409 activated to generate and present an audible reminder indicating that the user has activated both sensors thereby preventing a false alarm.

Figure 5:
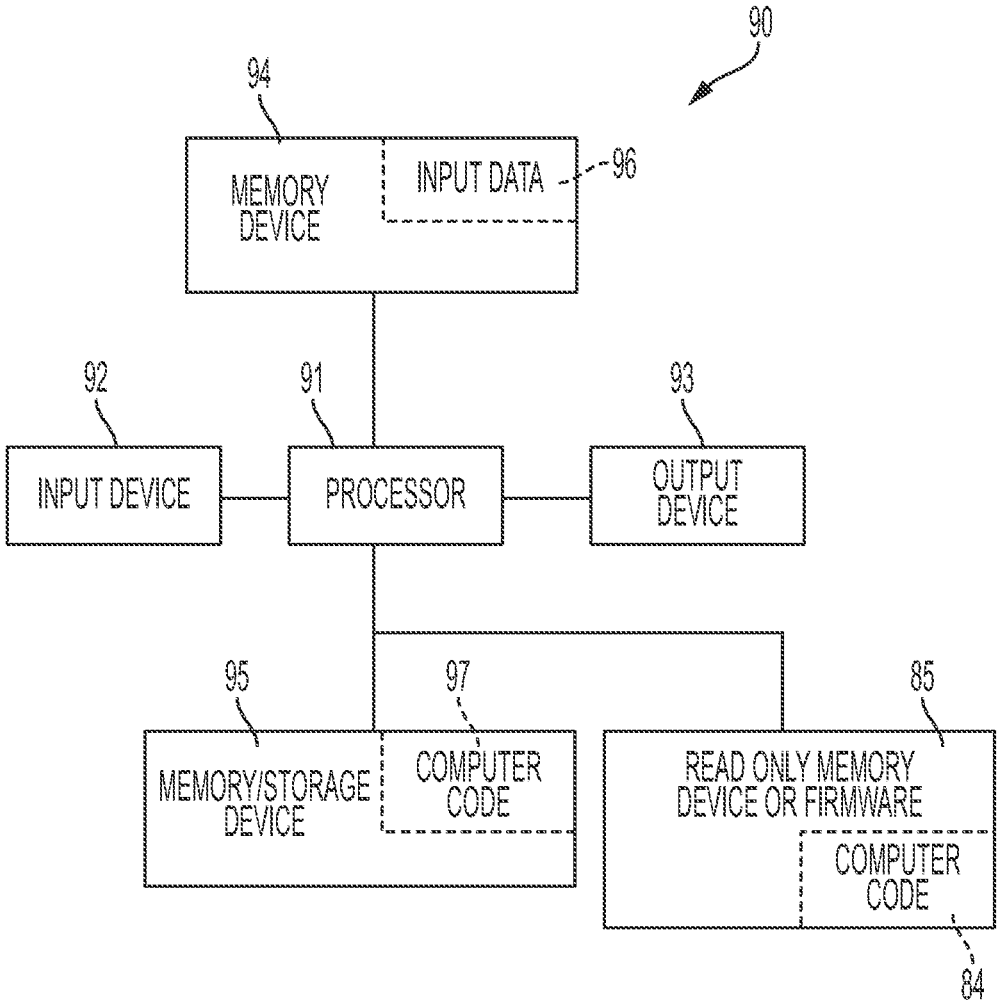
FIG. 5 illustrates a computer system used by the system of FIG. 1 for improving interactive security system technology associated with enabling sensors for detecting a user located within an exit point location of a structure and executing associated actions for automatically generating an associated alert and controlling a functionality of an alarm system, in accordance with embodiments of the present invention.

FIG. 5 illustrates a computer system 90 (e.g., alarm system 104, activating controller 105, and activation device 135 of FIG. 1) used by or comprised by the system of FIG. 1 for improving interactive security system technology associated with enabling sensors for detecting a user located within an exit point location of a structure and executing associated actions for automatically generating an associated alert and controlling a functionality of an alarm system, in accordance with embodiments of the present invention.

Aspects of the present invention may take the form of an entirely hardware embodiment, an entirely software embodiment (including firmware, resident software, micro-code, etc.) or an embodiment combining software and hardware aspects that may all generally be referred to herein as a "circuit," "module," or "system."

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing apparatus receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, device (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing device to produce a machine, such that the instructions, which execute via the processor of the computer or other programmable data processing device, create means for implementing the functions/acts specified in the flowchart and/or block diagram block or blocks. These computer readable program instructions may also be stored in a computer readable storage medium that can direct a computer, a programmable data processing device, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing device, or other device to cause a series of operational steps to be performed on the computer, other programmable device or other device to produce a computer implemented process, such that the instructions which execute on the computer, other programmable device, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The computer system 90 illustrated in FIG. 5 includes a processor 91, an input device 92 coupled to the processor 91, an output device 93 coupled to the processor 91, and memory devices 94 and 95 each coupled to the processor 91. The input device 92 may be, inter alia, a keyboard, a mouse, a camera, a touchscreen, etc. The output device 93 may be, inter alia, a printer, a plotter, a computer screen, a magnetic tape, a removable hard disk, a floppy disk, etc. The memory devices 94 and 95 may be, inter alia, a hard disk, a floppy disk, a magnetic tape, an optical storage such as a compact disc (CD) or a digital video disc (DVD), a dynamic random access memory (DRAM), a read-only memory (ROM), etc. The memory device 95 includes a computer code 97. The computer code 97 includes algorithms (e.g., the algorithm of FIG. 2) for improving interactive security system technology associated with enabling sensors for detecting a user located within an exit point location of a structure and executing associated actions for automatically generating an associated alert and controlling a functionality of an alarm system. The processor 91 executes the computer code 97. The memory device 94 includes input data 96. The input data 96 includes input required by the computer code 97. The output device 93 displays output from the computer code 97. Either or both memory devices 94 and 95 (or one or more additional memory devices Such as read only memory device 96) may include algorithms (e.g., the algorithm of FIG. 2) and may be used as a computer usable medium (or a computer readable medium or a program storage device) having a computer readable program code embodied therein and/or having other data stored therein, wherein the computer readable program code includes the computer code 97. Generally, a computer program product (or, alternatively, an article of manufacture) of the computer system 90 may include the computer usable medium (or the program storage device).

In some embodiments, rather than being stored and accessed from a hard drive, optical disc or other writeable, rewriteable, or removable hardware memory device 95, stored computer program code 84 (e.g., including algorithms) may be stored on a static, nonremovable, read-only storage medium such as a Read-Only Memory (ROM) device 85, or may be accessed by processor 91 directly from such a static, nonremovable, read-only medium 85. Similarly, in some embodiments, stored computer program code 97 may be stored as computer-readable firmware 85, or may be accessed by processor 91 directly from such firmware 85, rather than from a more dynamic or removable hardware data-storage device 95, such as a hard drive or optical disc.

Still yet, any of the components of the present invention could be created, integrated, hosted, maintained, deployed, managed, serviced, etc. by a service supplier who offers to improve interactive security system technology associated with enabling sensors for detecting a user located within an exit point location of a structure and executing associated actions for automatically generating an associated alert and controlling a functionality of an alarm system. Thus, the present invention discloses a process for deploying, creating, integrating, hosting, maintaining, and/or integrating computing infrastructure, including integrating computer-readable code into the computer system 90, wherein the code in combination with the computer system 90 is capable of performing a method for enabling a process for improving interactive security system technology associated with enabling sensors for detecting a user located within an exit point location of a structure and executing associated actions for automatically generating an associated alert and controlling a functionality of an alarm system. In another embodiment, the invention provides a business method that performs the process steps of the invention on a subscription, advertising, and/or fee basis. That is, a service supplier, such as a Solution Integrator, could offer to enable a process for improving interactive security system technology associated with enabling sensors for detecting a user located within an exit point location of a structure and executing associated actions for automatically generating an associated alert and controlling a functionality of an alarm system. In this case, the service supplier can create, maintain, support, etc. a computer infrastructure that performs the process steps of the invention for one or more customers. In return, the service supplier can receive payment from the customer(s) under a subscription and/or fee agreement and/or the service supplier can receive payment from the sale of advertising content to one or more third parties.

While FIG. 5 shows the computer system 90 as a particular configuration of hardware and software, any configuration of hardware and software, as would be known to a person of ordinary skill in the art, may be utilized for the purposes stated supra in conjunction with the particular computer system 90 of FIG. 4. For example, the memory devices 94 and 95 may be portions of a single memory device rather than separate memory devices.

Cloud Computing Environment

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 6:
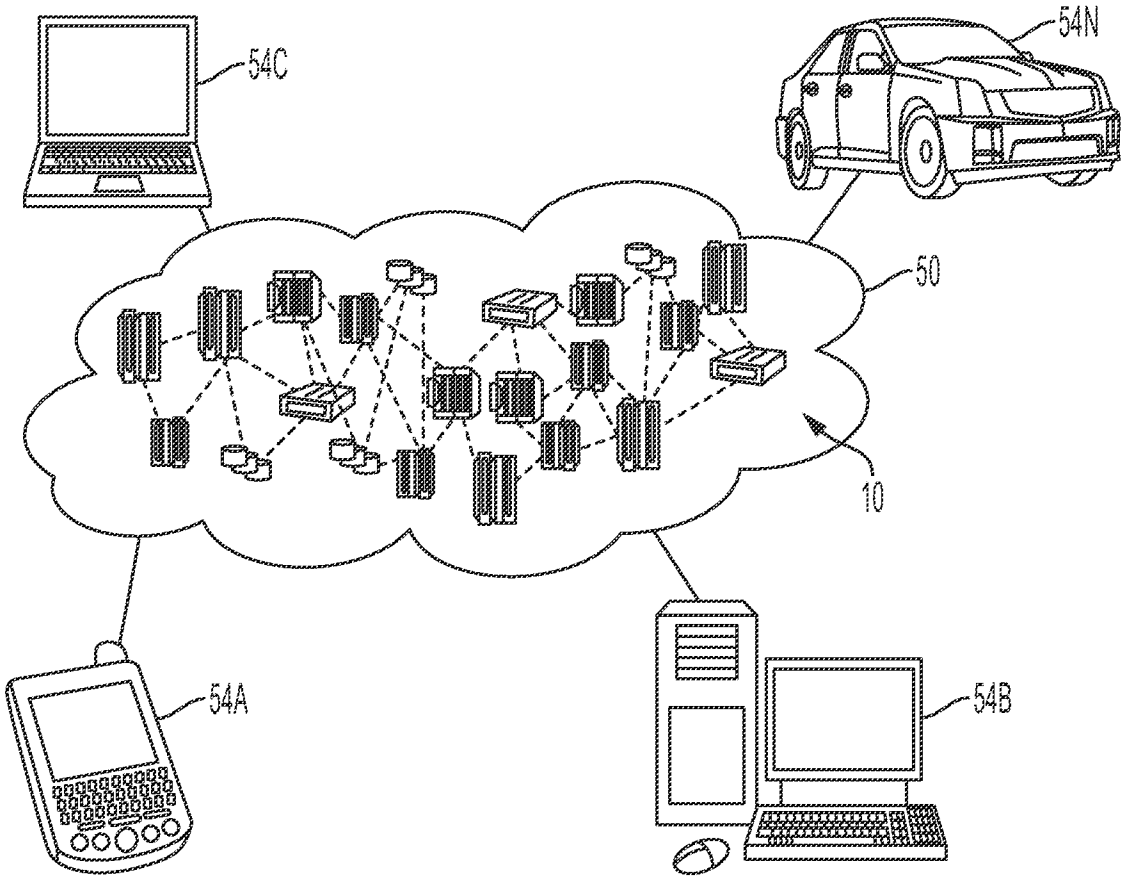
FIG. 6 illustrates a cloud computing environment, in accordance with embodiments of the present invention.

Referring now to FIG. 6, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A, 54B, 54C and 54N shown in FIG. 5 are intended to be illustrative only and that computing nodes 10 and cloud computing environment 50 can communicate with any type of computerized device over any type of network and/or network addressable connection (e.g., using a web browser).

Figure 7:
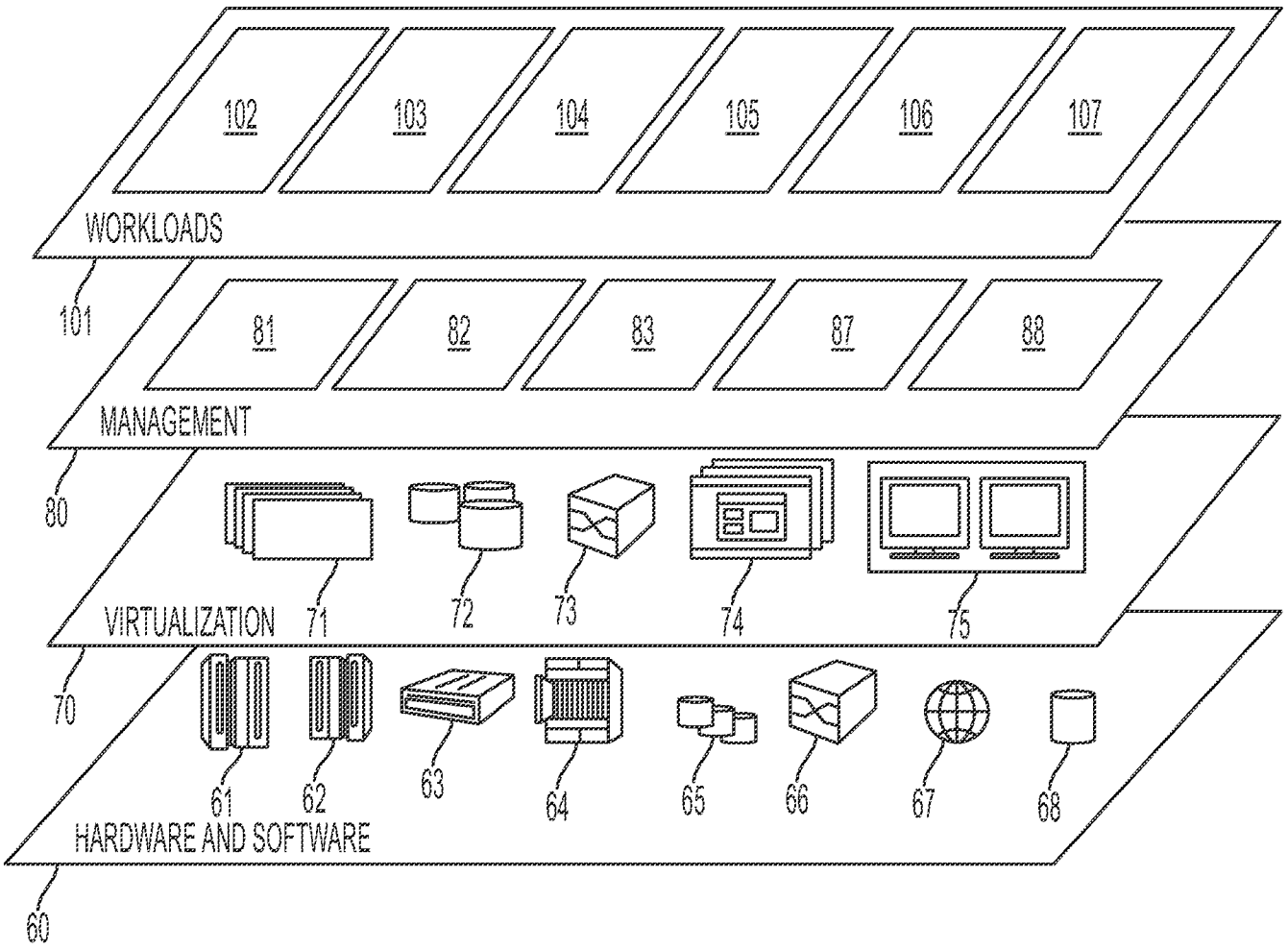
FIG. 7 illustrates a set of functional abstraction layers provided by cloud computing environment, in accordance with embodiments of the present invention.

Referring now to FIG. 7, a set of functional abstraction layers provided by cloud computing environment 50 (see FIG. 6) is shown. It should be understood in advance that the components, layers, and functions shown in FIG. 6 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 101 provides examples of functionality for which the cloud computing environment may be utilized. Examples of workloads and functions which may be provided from this layer include: mapping and navigation 102; software development and lifecycle management 103; virtual classroom education delivery 104; data analytics processing 105; transaction processing 106; and for improving interactive security system technology associated with enabling sensors for detecting a user located within an exit point location of a structure and executing associated actions for automatically generating an associated alert and controlling a functionality of an alarm system 107.

While embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. An interactive security alert improvement method comprising:

querying, by a processor of a connected device, a status associated with an alarm system resulting in detection of an active state associated with said alarm system;

detecting in real time, by said processor via sensors communicatively connected to said alarm system, a user located within a specified proximity of an exit structure of an exit point location of a structure, wherein said user is currently located within said structure such that said exit point location prevents said user from exiting said structure, wherein said exit point location comprises an activating device associated with said exit structure, wherein said sensor is integrated with said activating device, wherein said activating device comprises door knob and latch connected to a security hub of said alarm system and said exit structure, said sensors, and control circuitry, and wherein said detecting in real time further comprises:

detecting, via a touch sensor of said sensors, that said user has physically touched said activating device; and detecting, via a biometric sensor of said sensors, biometric attributes of said user;

generating, by said processor, an alert indicating that: said user has touched said activating device, said biometric attributes have been detected, and said user is located within said specified proximity of said exit point location of said structure; and disabling, by said processor in response to feedback associated with an alert presented to said user via a user interface, said alarm system.

2. The method of claim 1, wherein said sensors comprise a proximity sensor selected from the group consisting of a motion detector, an optical sensor, an audio sensor, a video sensor, and a temperature sensor.

3. The method of claim 1, further comprising:

detecting, by said processor via said biometric sensor, an identity of said user associated with said alert.

4. The method of claim 3, wherein said biometric sensor comprises a sensor selected from the group consisting of a facial recognition sensor and a finger print sensor.

5. The method of claim 1, further comprising:

activating, by said processor in response to said feedback, said alarm system.

6. The method of claim 1, further comprising:

detecting by said processor, that a specified time period has elapsed.

7. The method of claim 1, wherein said alert comprises a visual alert.

8. The method of claim 1, wherein said alert comprises an audible alert presented to said user.

9. The method of claim 1, wherein said alert comprises a vibrational alert presented to said user.

10. The method of claim 1, further comprising:

detecting, by said processor via said sensors, a medical condition associated with said user; and notifying, by said processor in response to said detecting said medical condition, an emergency services system.

11. The method of claim 1, further comprising:

providing at least one support service for at least one of creating, integrating, hosting, maintaining, and deploying computer-readable code in the control hardware, said code being executed by the computer processor to implement: said querying, said detecting in real time, said detecting, and said generating.

12. A computer program product, comprising a computer readable hardware storage device storing a computer readable program code, said computer readable program code comprising an algorithm that when executed by a processor of a connected device implements an interactive security alert improvement method, said method comprising:

querying, by said processor, a status associated with an alarm system resulting in detection of an active state associated with said alarm system;

detecting in real time, by said processor via sensors communicatively connected to said alarm system, a user located within a specified proximity of an exit structure of an exit point location of a structure, wherein said user is currently located within said structure such that said exit point location prevents said user from exiting said structure, wherein said exit point location comprises an activating device associated with said exit structure, wherein said sensor is integrated with said activating device, wherein said activating device comprises door knob and latch connected to a security hub of said alarm system and said exit structure, said sensors, and control circuitry, and wherein said detecting in real time further comprises:

detecting, via a touch sensor of said sensors, that said user has physically touched said activating device; and detecting, via a biometric sensor of said sensors, biometric attributes of said user;

generating, by said processor, an alert indicating that: said user has touched said activating device, said biometric attributes have been detected, and said user is located within said specified proximity of said exit point location of said structure; and disabling, by said processor in response to feedback associated with an alert presented to said user via a user interface, said alarm system.

13. The computer program product of claim 12, wherein said sensors comprise a proximity sensor selected from the group consisting of a motion detector, an optical sensor, an audio sensor, a video sensor, and a temperature sensor.

14. The computer program product of claim 12, wherein said method further comprises:

detecting, by said processor via said biometric sensor, an identity of said user associated with said alert.

15. The computer program product of claim 14, wherein said biometric sensor comprises a sensor selected from the group consisting of a facial recognition sensor and a finger print sensor.

16. The computer program product of claim 12, wherein said method further comprises:

activating, by said processor in response to said feedback, said alarm system.

17. The computer program product of claim 12, wherein said method further comprises:

detecting by said processor, that a specified time period has elapsed.

18. The computer program product of claim 12, wherein said alert comprises presenting a visual alert to said user.

19. The computer program product of claim 12, wherein said alert comprises an audible alert presented to said user.

20. A hardware device comprising a processor coupled to a computer-readable memory unit, said memory unit comprising instructions that when executed by the computer processor implements an interactive security alert method comprising:

querying, by said processor, a status associated with an alarm system resulting in detection of an active state associated with said alarm system;

detecting in real time, by said processor via sensors communicatively connected to said alarm system, a user located within a specified proximity of an exit structure of an exit point location of a structure, wherein said user is currently located within said structure such that said exit point location prevents said user from exiting said structure, wherein said exit point location comprises an activating device associated with said exit structure, wherein said sensor is integrated with said activating device, wherein said activating device comprises door knob and latch connected to a security hub of said alarm system and said exit structure, said sensors, and control circuitry, and wherein said detecting in real time further comprises:

detecting, via a touch sensor of said sensors, that said user has physically touched said activating device; and detecting, via a biometric sensor of said sensors, biometric attributes of said user;

generating, by said processor, an alert indicating that: said user has touched said activating device, said biometric attributes have been detected, and said user is located within said specified proximity of said exit point location of said structure; and disabling, by said processor in response to feedback associated with an alert presented to said user via a user interface, said alarm system.

* * * * *